US008313312B2

(12) United States Patent
Fujimoto et al.

(10) Patent No.: US 8,313,312 B2
(45) Date of Patent: Nov. 20, 2012

(54) SCREW COMPRESSOR

(75) Inventors: Hideki Fujimoto, Shizuoka (JP); Hitoshi Nishimura, Shizuoka (JP); Yusuke Nagai, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 477 days.

(21) Appl. No.: 12/533,688

(22) Filed: Jul. 31, 2009

(65) Prior Publication Data

US 2010/0135840 A1 Jun. 3, 2010

(30) Foreign Application Priority Data

Nov. 28, 2008 (JP) ..... 2008-304641

(51) Int. Cl.
*F04B 39/02* (2006.01)

(52) U.S. Cl. ..... 417/367; 417/321; 418/201.1

(58) Field of Classification Search ..... 417/321, 417/367; 418/201.1; 165/100, 101
See application file for complete search history.

(56) References Cited

U.S. PATENT DOCUMENTS

| | | | | |
|---|---|---|---|---|
| 6,551,082 | B2 * | 4/2003 | Douzono et al. | 418/83 |
| 2006/0280626 | A1 * | 12/2006 | Nishimura et al. | 417/410.4 |

FOREIGN PATENT DOCUMENTS

| | | |
|---|---|---|
| JP | 1-116297 A | 5/1989 |
| JP | 01-312357 | 12/1989 |
| JP | 11-141488 | 5/1999 |
| JP | 11-141488 A | 5/1999 |
| JP | 11-294335 | 10/1999 |
| JP | 2003-328752 | 11/2003 |
| JP | 2005-282362 | 10/2005 |

OTHER PUBLICATIONS

Japanese Office Action mailed Jul. 24, 2012.

* cited by examiner

*Primary Examiner* — Charles Freay
*Assistant Examiner* — Patrick Hamo
(74) *Attorney, Agent, or Firm* — Crowell & Moring LLP

(57) ABSTRACT

A screw compressor comprising: a pair of male and female screw rotors; and an air-cooled heat exchanger, wherein the air-cooled heat exchanger is provided above a motor for driving the compressor body; wherein, with respect to a cooling wind for the air-cooled heat exchanger, the air-cooled heat exchanger is inclined to the upstream side; wherein the uppermost portion of a unit suction port for the air-cooled heat exchanger cooling winds is positioned below the uppermost portion of the air-cooled heat exchanger positioned at the uppermost portion; wherein the lowermost portion of the unit suction port for the air-cooled heat exchanger cooling wind is positioned below the lowermost portion of the air-cooled heat exchanger positioned at the lowermost portion; and wherein the cooling wind for the air-cooled heat exchanger is exhausted from a ceiling portion of the compressor unit. With this structure, it becomes possible to provide a compact screw compressor with less noise whose installation area can be reduced.

20 Claims, 3 Drawing Sheets

(1) FLOW OF COOLING WIND OF AIR-COOLED HEAT EXCHANGER
(2) FLOW OF COOLING WIND FOR MOTOR

SCREW COMPRESSOR

BACKGROUND OF THE INVENTION

1. Field of the Invention

The present invention relates to a screw compressor. More specifically, it relates to a screw compressor capable of reducing noise caused by operation of the compressor.

2. Description of the Related Art

There is known an oil free, or no-oil injected screw compressor which compresses air by using its pair of male and female screw rotors capable of rotating in a non-contact state with no oil supplied. The oil free screw compressor has a compressor body to compress air. The temperature of the compressed air discharged from the compressor body is very high. Therefore, in most cases, a cooler (heat exchanger) for cooling the compressed air is installed. The compressed air discharged from the compressor body passes through connection pipes inside the cooler and compressor unit to be discharged to outside of the compressor unit. As conventional technologies of this kind, Patent Document 1 discloses a structure of a single-stage oil free screw compressor and Patent Document 2 discloses a two-stage oil free screw compressor having two compressor bodies.

(Patent Document 1) Japanese Patent Laid-open No. 01-116297

(Patent Document 2) Japanese Patent Laid-open No. 11-141488

SUMMARY OF THE INVENTION

For example, in an oil free screw compressor, lubricating oil is not injected for sealing between a pair of male and female rotors of its compressor body. Therefore, leakage through a clearance between rotors and leakage through a clearance formed in the teeth groove, or in the periphery of a compressor chamber greatly affect the efficiency of the compressor of this kind. Generally, in the oil free screw compressor, in order to achieve a certain level of efficiency by overcoming such leakage, rotors are driven at a high speed of about 10000 to 20000 rpm.

Further, a compressed air from the compressor body is discharged intermittently through a discharge port. The discharged flow rate varies according to a meshing cycle made by multiplying the number of teeth of the rotor by the rpm of the rotor, resulting in the pulsation in pressure at the discharge port. The pressure pulsation during the discharge is transmitted from the compressor body itself or the pipes connected to the compressor body to a cooler (heat exchanger) for air cooling of the compressor, causing vibration noise. In particular, as compared to an oil injection screw compressor whose rotors rotate at 3000 to 4000 rpm, the rotors of the oil free screw compressor rotate at a very high speed, producing a high frequency noise of several thousand hertz.

According to Patent Document 1, since a cooler is provided close to a delivery port of a cooling wind of the case, vibration noise of the heat exchanger is liable to directly leak to outside of the case. Further, according to Patent Document 2, suction ports of a duct are provided in an opposed manner next to the upstream side of the heat exchanger (cooler). Therefore, the vibration noise of the heat exchanger may go forward along the duct to leak to outside of the case.

The present invention is made in view of the above problems, and is directed, in particular, to a screw compressor having an air-cooled heat exchanger, which is a component having the largest sound emitting area in the compressor unit. The object of the present invention is to provide a compact screw compressor emitting less noise and using a small installation area without disturbing the cooling capability of a heat exchanger by providing the air-cooled heat exchanger at a central part in the unit.

In order to achieve the above object, according to the present invention, there is provided an oil free screw compressor comprising: a compressor body having a pair of male and female screw rotors; an air-cooled heat exchanger for cooling a lubricating oil in the compressor; an air-cooled heat exchanger for cooling a compressed air discharged from the compressor; and a case for receiving the above components, wherein the oil free screw compressor further comprises: a motor disposed at the bottom of the case for driving the compressor; and a duct which takes in air from an area below the case and discharges it from a ceiling portion and whose central part extends above the motor; wherein the above air-cooled heat exchanger is provided in an inclined manner at a central part of the duct; and wherein a suction duct for reducing noise of the air-cooled heat exchanger is provided closer to a suction side than to the central part of the duct.

In the screw compressor described above, a cooling fan is provided in the duct on the upstream side of the air-cooled heat exchanger.

In the screw compressor described above, a cooling fan is provided in the duct on the downstream side of an air-cooled heat exchanger.

In any of the screw compressors described above, the suction duct is formed as a louver structure in which an upper portion of a suction port of the duct may be located below the uppermost portion of the air-cooled heat exchanger and a lower portion of the suction port of the duct may be located below the lowermost portion of the air-cooled heat exchanger.

Further, in any of the screw compressors described above, the suction duct is formed as a louver structure in which a channel has two or more angles.

Still further, in any of the screw compressors described above, the suction duct is formed as a louver structure having two or more channels.

Still further, in the screw compressor described above, the two or more channels are formed such that they merge immediately before the air-cooled heat exchanger.

Still further, in any of the screw compressors described above, a cooling channel which cools the motor is provided in a lower portion of the suction duct.

Still further, in any of the screw compressors described above, there is provided an exhaust duct extending from a central part of the above duct to a ceiling portion of the case, the exhaust duct having two or more angles with respect to an exhaust direction or being in an arch-like shape.

Still further, in the screw compressor described above, there is provided, in the exhaust duct, a suction port for waste heat for cooling the cooling fan motor and for waste heat ventilation in the case.

Still further, in the screw compressor described above, the compressor body is an oil free screw compressor having a pair of male and female screw rotors which can rotate in a non-contact state with no oil supplied.

According to the present invention, while reducing the noise of the screw compressor, the installation area can be reduced and the compressor can be made compact.

BRIEF DESCRIPTION OF THE DRAWINGS

FIG. 2A-FIG. 2D show a unit structure of the oil free screw compressor, wherein FIG. 2A is a top view, FIG. 2B is a left side view, FIG. 2C is a front sectional view, and FIG. 2D is a right side view.

FIG. 3A-FIG. 3B show the spatial relationship between an air-cooled heat exchanger and a suction port of the oil free screw compressor, wherein FIG. 3A is a front sectional view and FIG. 3B is a right side view.

DETAILED DESCRIPTION OF THE PREFERRED EMBODIMENTS

The present invention is generally directed to a screw compressor having an air-cooled heat exchanger and is not limited to an oil free screw compressor. However, as compared to an oil injected screw compressor, it is preferable to be used in the oil free type. Therefore, hereinafter, as an embodiment of the present invention, there is described an oil free screw compressor having a compressor body including a pair of male and female screw rotors which can rotate in a non-contact state with no oil supplied.

Figure 1:
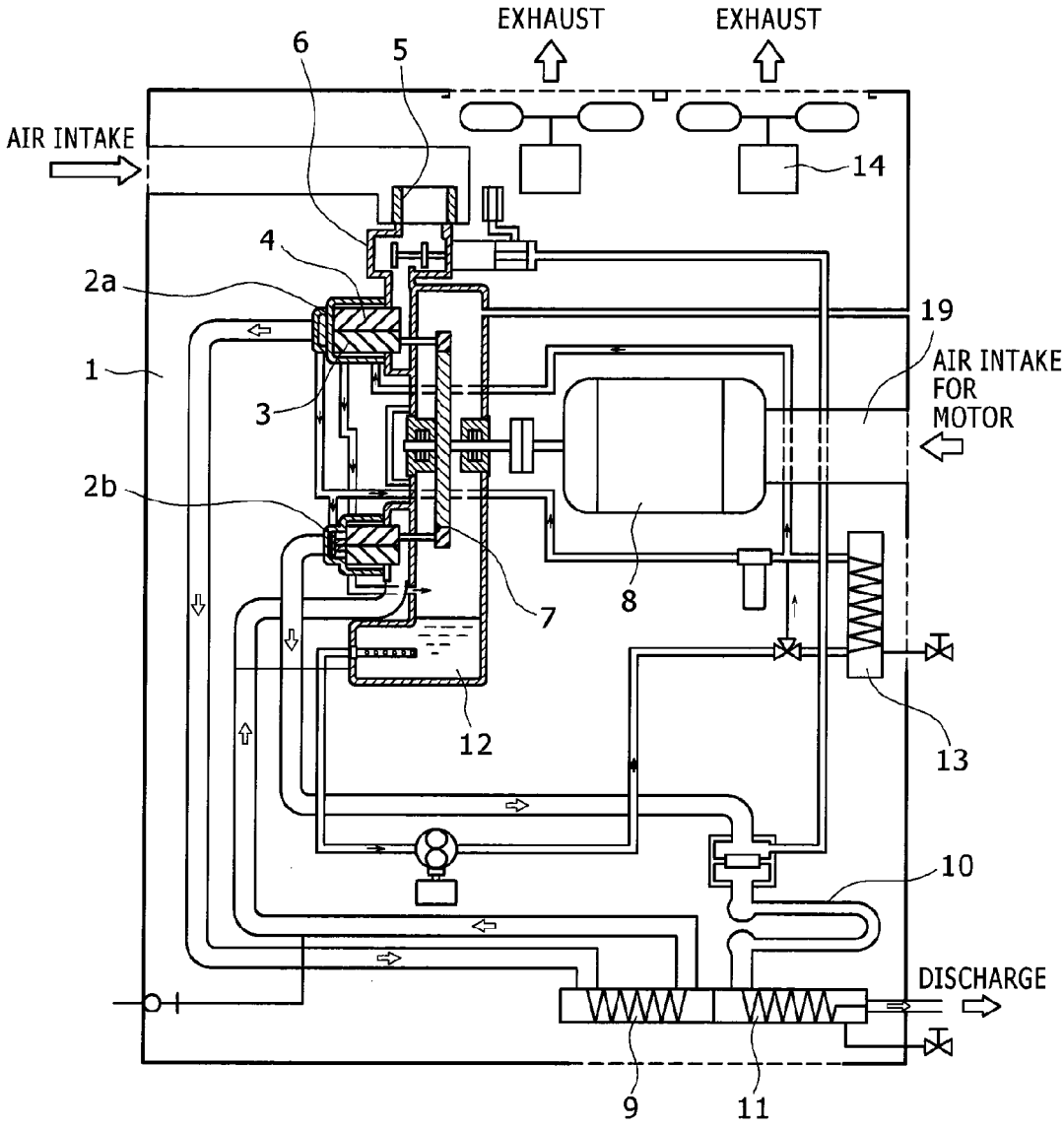
FIG. 1 shows a structure of an oil free screw compressor and a flow of a compressed air and lubricating oil.

FIG. 1 shows an overall structure of the oil free screw compressor and a flow of a compressed air and lubricating oil. In FIG. 1, the oil free screw compressor received in the compressor unit case 1 is a two-stage compressor and has a low-pressure stage compressor body 2*a* and a high-pressure stage compressor body 2*b*. A throttle valve 6 is provided on an upstream side of a suction gas passage of the low-pressure stage compressor body 2*a*. Further, the compressor body receives, in its compression chamber, a male rotor 3 and a female rotor 4, which are a pair of screw rotors. The male and female rotors 3 and 4 are rotatably provided in a non-contact state with no oil supplied. There is a groove formed in its outer periphery as a gas passage whose capacity varies.

The two compressor bodies 2*a* and 2*b* are rotated, through a drive gear 7, by a motor 8 for driving compressor bodies. The gas to be used for compression is taken in from the outside through a suction filter 5 at an ordinary temperature and is supplied to the low-pressure stage compressor body 2*a*. The air compressed here passes the low-pressure stage air-cooled heat exchanger 9 through a pipe to be cooled, and then supplied to the high-pressure stage compressor body 2*b* through a pipe. The air further compressed by the high-pressure stage compressor body 2*b* passes a pre-stage heat exchanger 10 (pre-cooler) for a high-pressure stage air-cooled heat exchanger 11 to be installed, as required, on an upstream side of the high-pressure stage air-cooled heat exchanger 11. Then, the air is supplied to the high-pressure stage air-cooled heat exchanger 11 to be cooled and discharged to outside of the compressor unit.

Also, the lubricating oil filled in a gear case 12 is cooled to a proper temperature by an air-cooled heat exchanger 13 for the compressor lubricating oil. Further, it is supplied to a compressor shaft bearing including the inner space of the compressor body and a drive gear 7 for cooling and rotation lubricating, and then collected in the gear case 12.

In the screw compressor having such a structure, when the capacity of the compression chamber formed by the pair of male and female rotors and the casing decreases, the air is compressed. At the end of the compression process, the compression chamber is brought into communication with a discharge chamber and the air is discharged to the discharge chamber side. However, since the amount of the discharge flow rate varies according to a meshing cycle of the rotors, there is caused pulsation in pressure. According to the pulsation, a force is applied to the compressor body itself to cause casing vibration and noise. Also, the pressure pulsation is transmitted to the downstream side through the compressed air. In the oil free screw compressor which has an air-cooled heat exchanger, in the passage route of the compressed air, the air-cooled heat exchanger has the largest sound emitting area, and it is one of the biggest sources of noise in the compressor unit.

In order to solve the above problem, an explanation will be given of a unit structure of the oil free screw compressor including an air-cooled heat exchanger which has an actual spatial relationship of the present embodiment.

Figure 2A:
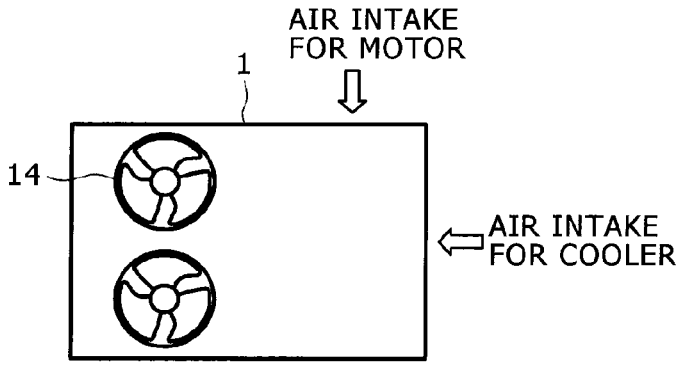
Figure 2B:
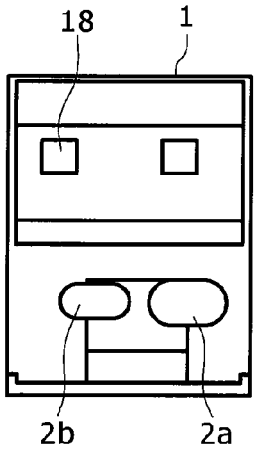
Figure 2C:
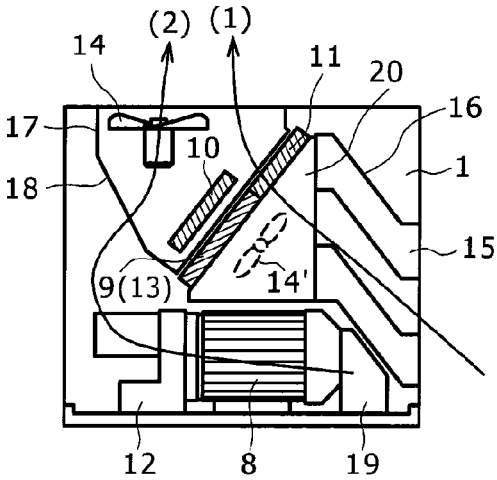
Figure 2D:
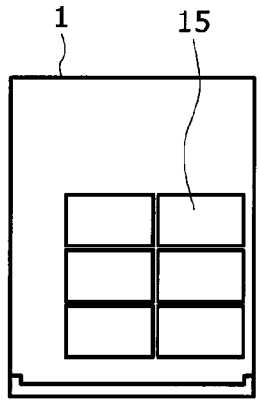

In FIG. 2C, the motor 8 for driving the compressor is disposed at the bottom of the unit case 1. Also, there is provided a duct in which air is taken in through a suction port 15 below a side wall of the case 1 and is discharged from a ceiling portion of the case 1, and its central part extends above the motor 8. The duct comprises a suction duct 16, a central duct 20 (central part of the duct), and an exhaust duct 17 being connected and communicated with each other. The central duct 20 is disposed above the motor 8 or above the height of the motor 8. In the central duct 20, the air-cooled heat exchangers 9, 10, and 11 are disposed in an inclined manner. Further, in the suction duct 16 connected to the suction port 15, there is a structure provided to suppress the noise caused by the air-cooled heat exchanger. Moreover, an exhaust fan 14 is provided in the exhaust duct 17. The exhaust fan 14 takes in a cooling wind through the suction port 15, allows it to pass through the heat exchanger to be discharged to outside of the case 1 from the ceiling. Also, the air-cooled heat exchanger may include a heat exchanger 13.

As shown in FIG. 2C, the heat exchangers 9, 10, 11, which are sources of noise, are disposed at the central part of the unit case 1. Therefore, the heat exchangers are spaced from the suction port 15 of the duct and the exhaust port of the ceiling. Thus, it becomes possible to prevent the noise caused by the heat exchangers from escaping to outside of the case through the suction port 15 and the exhaust port.

To save space, the air-cooled heat exchangers may be piled up above an upper portion of the motor 8 for driving the compressor body or the uppermost portion of the motor. Thus, the installation area of the compressor unit case can be reduced. At the same time, by inclining each air-cooled heat exchanger to the upstream side with respect to the cooling wind, the height of the compressor unit case can be reduced.

Figure 3A:
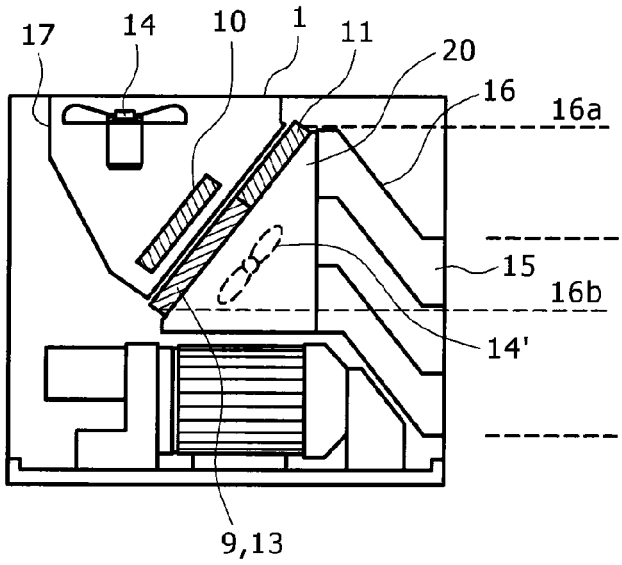
Figure 3B:
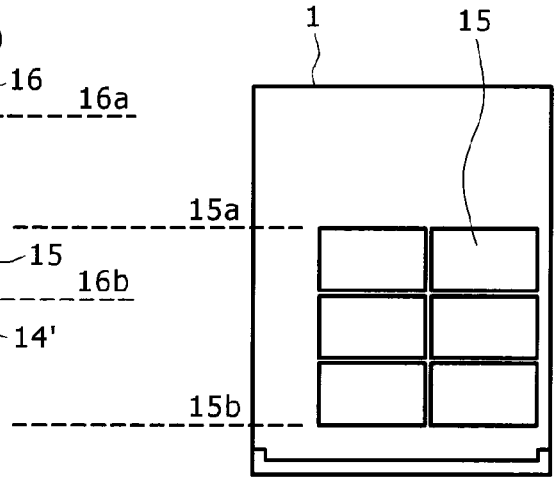

Now, as a structure of the suction duct 16 for suppressing the noise in the air-cooled heat exchanger, the spatial relationship between the air-cooled heat exchanger and the suction port 15 of the duct will be explained. That is, as shown in FIG. 3A, the suction duct 16 is allowed to have a louver structure (louver door structure) with two or more angles such that the uppermost portion 15*a* of the suction port 15 of the duct is located below the uppermost portion 16*a* of the heat exchanger and the lowermost portion 15*b* of the suction port 15 of the duct is located below the lowermost portion 16*b* of the heat exchanger. The louver structure is formed so that it may be inclined downward facing the suction port 15 side. Further, substantially parallel two or more channels may be provided as channels for the suction duct 16 so that taken-in cooling winds may merge immediately before the heat exchanger. Furthermore, it may be a sound absorption structure in which a sound-absorbing material is affixed inside the suction duct 16.

Thus, the suction duct 16 has the louver structure facing downward toward the suction port 15 side with two or more angles. Therefore, the sound emitted from the air-cooled heat exchanger is attenuated by the inner wall of the duct 16. Further, it is prevented from directly passing through the suction port 15 and is kept from escaping through the suction port 15. Also, when the noise which collided with the inner wall of the duct 16 does pass through the suction port 15, it escapes through the suction port downward due to the downward louver structure. Therefore, the noise reduction effect by sound insulation is obtained for the benefit of workers at the site. Moreover, if a sound-absorbing material is affixed inside the suction duct 16, a silencing effect can be improved. Further, the two or more channels are provided for the suction duct 16. Therefore, the inner wall area of the suction duct 16 is increased, making it possible to increase the collision opportunity with the noise and to increase the sound absorption area (if the sound-absorbing material is affixed). Thus, the noise caused by the leakage of sound from the suction port 15 can be reduced.

Also, the air-cooled heat exchanger is isolated in the duct side from other components in the case 1 and cooled by the cooling wind flowing there. Thus, the waste heat generated in the compressor body, a motor, etc. inside the case 1 does not enter the cooling wind in the duct, preventing the temperature from rising.

Now, with respect to the cooling wind for the air-cooled heat exchangers, a structure of the downstream side of the air-cooled heat exchangers will be explained. First, because of the compression ratio of the low-pressure stage compressor body 2*a* or the high-pressure stage compressor body 2*b*, when the temperature of the discharged compressed air exceeds the heat-resistant temperature of the air-cooled heat exchangers 9, 11 or the temperature to shorten their lives, for thermal fatigue protection, a pre-stage air-cooled heat exchanger (pre-cooler) must be installed for the low-pressure air-cooled heat exchanger 9 or the high-pressure air-cooled heat exchanger 11 or both the heat exchangers. In such cases, with respect to the cooling wind for the air-cooled heat-exchangers, the pre-stage air-cooled heat exchangers are installed downstream of the air-cooled heat exchangers.

In FIG. 1, the pre-stage air-cooled heat exchanger 10 is installed on the side of the high-pressure air-cooled heat exchanger 11. In FIG. 2C, the pre-stage air-cooled heat exchanger 10 is installed downstream of the air-cooled heat exchangers 9 and 10. The reason is that the compressed air temperature supplied to the pre-stage air-cooled heat exchanger 10 is higher than that of the air-cooled heat exchangers 9 and 10 for the compressed air and it is possible enough to perform heat exchanging even with use of the cooling wind (waste wind) which has passed through the heat exchangers 9 and 11.

The pre-stage air-cooled heat exchanger described above is installed as required. Then, the downstream side of the air-cooled heat exchanger and the ceiling portion of the compressor unit case 1 are connected through the exhaust duct 17, and a cooling fan 14 is installed inside the exhaust duct 17 (FIG. 2C). The above exhaust duct 17 extends from the central duct 20 to the ceiling portion of the case, having two or more angles with respect to the exhaust direction or has an arc-like shape. By mounting the exhaust duct 17, the rise in temperature inside the compressor unit case 1 due to the waste heat from the air-cooled heat exchanger is prevented. Also, what is necessary is just to install the cooling fan which has a static pressure high enough to overcome the loss in the cooling wind pressure caused by the suction duct 16, the air-cooled heat exchanger, and the exhaust duct 17. At the same time, it becomes possible to allow the cooling fan to be compact and to make it easier to perform CAE calculation in designing the duct. Further, the cooling fan may be provided upstream of the air-cooled heat exchanger of the central duct 20 (shown by numeral 14' in FIG. 2C and FIG. 3A).

According to the present embodiment, the installation area of the compressor unit case 1 can be reduced. At the same time, the sound emitted from the air-cooled heat exchanger can be reduced. Also, because of the duct structure, a flow which does not disturb the flow of the cooling wind of the air-cooled heat-exchanger can be formed ((1) in FIG. 2C). Moreover, when the compressor unit case 1 is installed in a room, the cooling wind for the air-cooled heat-exchanger is taken in from a lower portion having a lower room temperature, which is advantageous for cooling of the air-cooled heat exchanger. At the same time, the suction port for the cooling wind of the air-cooled heat-exchanger can also be disposed below an ear position of a worker at the site. Thus, the structure of the present embodiment can be such that in addition to the noise reduction in the compressor unit case 1, it is preferable for human auditory sense because of the suction port being disposed low.

Next, with reference to FIG. 1 and FIG. 2C, a method of exhausting the waste heat generated in the compressor unit case 1 will be explained. The structure is such that a cooling channel 19 is provided in a lower space of the suction duct 16 or the lower space itself of the suction duct 16 is used as a cooling channel. Further, in the exhaust duct 17, a suction port 18 for the waste heat of the motor and the interior of the unit case is provided. When the cooling fan 14 is driven, the waste heat inside the case 1 is taken in through the suction port 18 for waste heat. Accordingly, after having passed through the cooling channel 19 and cooled the motor 8, the cooling wind for the drive motor 8 of the compressor body carries the waste heat of the compressor body, etc. and is discharged to outside from the ceiling of the compressor unit case through the exhaust duct.

Moreover, the flow for cooling the cooling fan motor can be formed by aligning the positions of the motor and the suction port 18 for the waste heat of the unit with the position of the fan motor of the cooling fan 14 ((2) in FIG. 2C). The temperature of the waste heat in the compressor unit case 1 including the waste heat in the motor 8 for driving the compressor is low as compared to the waste heat temperature of the air-cooled heat exchanger. Therefore, it is usable enough as a cooling wind for the cooling fan motor.

As described above, space-saving is achieved by effective use of the space in the compressor unit case, and it becomes possible to provide a low-noise and compact oil-free screw compressor using a small installation area.

What is claimed is:

1. A screw compressor comprising: a compressor body having a pair of male and female screw rotors; an air-cooled heat exchanger for cooling a lubricating oil of the compressor; an air-cooled heat exchanger for cooling a compressed air discharged from the compressor; and a case for receiving the components described above, wherein the screw compressor further includes: a motor for driving the compressor disposed at the bottom of the case; and a duct which takes in air from a lower portion of the case and discharges it from a ceiling portion, the duct having a central part that extends above an upper portion of the motor;

wherein the air-cooled heat exchanger for cooling the compressed air is disposed at the central part of the duct in an inclined manner; and wherein a suction duct for suppressing noise of the air-cooled heat exchanger is provided closer to a suction side than to the central part of the duct.

2. A screw compressor according to claim 1, wherein a cooling fan is provided in the duct on an upstream side of the air-cooled heat exchanger for cooling the compressed air.

3. A screw compressor according to claim 1, wherein a cooling fan is provided in the duct on a downstream side of the air-cooled heat exchanger for cooling the compressed air.

4. A screw compressor according to claim 1, wherein said suction duct is formed as a louver structure in which an upper portion of a suction port of the duct is positioned lower than the uppermost portion of the air-cooled heat exchanger for cooling the compressed air; and wherein a lower portion of the suction port of the duct is positioned below the lowermost portion of the air-cooled heat exchanger for cooling the compressed air.

5. A screw compressor according to claim 1, wherein the suction duct is formed as a louver structure in which a channel has two or more angles.

6. A screw compressor according to claim 1, wherein said suction duct is formed as a louver structure having two or more channels.

7. A screw compressor according to claim 6, wherein the two or more channels merge immediately before the air-cooled heat exchanger.

8. A screw compressor according to claim 1, wherein a cooling channel for cooling said motor is provided in a lower portion of the suction duct.

9. A screw compressor according to claim 1, wherein there is provided an exhaust duct extending from the central part of the duct to the ceiling portion of the case which has two or more angles with respect to an exhaust direction or which is in an arc-like shape.

10. A screw compressor according to claim 9, wherein there is provided, in the exhaust duct, a suction port for waste heat for cooling the cooling fan and for waste heat ventilation in the case.

11. A screw compressor according to claim 1, wherein said compressor body has a pair of male and female screw rotors which can rotate in a non-contact state with no oil supplied.

12. A screw compressor according to claim 2, wherein said compressor body has a pair of male and female screw rotors which can rotate in a non-contact state with no oil supplied.

13. A screw compressor according to claim 3, wherein said compressor body has a pair of male and female screw rotors which can rotate in a non-contact state with no oil supplied.

14. A screw compressor according to claim 4, wherein said compressor body has a pair of male and female screw rotors which can rotate in a non-contact state with no oil supplied.

15. A screw compressor according to claim 5, wherein said compressor body has a pair of male and female screw rotors which can rotate in a non-contact state with no oil supplied.

16. A screw compressor according to claim 6, wherein said compressor body has a pair of male and female screw rotors which can rotate in a non-contact state with no oil supplied.

17. A screw compressor according to claim 7, wherein said compressor body has a pair of male and female screw rotors which can rotate in a non-contact state with no oil supplied.

18. A screw compressor according to claim 8, wherein said compressor body has a pair of male and female screw rotors which can rotate in a non-contact state with no oil supplied.

19. A screw compressor according to claim wherein said compressor body has a pair of male and female screw rotors which can rotate in a non-contact state with no oil supplied.

20. A screw compressor according to claim 10, wherein said compressor body has a pair of male and female screw rotors which can rotate in a non-contact state with no oil supplied.

* * * * *